US005913773A

United States Patent [19]

Cox

[11] Patent Number: 5,913,773

[45] Date of Patent: Jun. 22, 1999

[54] PAPER HANDLING DEVICE

[76] Inventor: Dawn M. Cox, 16 Caprice Dr., Buffalo, N.Y. 14227

[21] Appl. No.: 08/831,919

[22] Filed: Apr. 2, 1997

[51] Int. Cl.[6] ..... A61G 7/07

[52] U.S. Cl. ..... 5/600; 5/487; 5/488

[58] Field of Search ..... 5/600, 487, 480; 297/221, 222

[56] References Cited

U.S. PATENT DOCUMENTS

| | | | |
|---|---|---|---|
| 886,102 | 4/1908 | Wheeler | 297/221 |
| 1,748,179 | 2/1930 | Koplin . | |
| 1,877,610 | 9/1932 | Steiner | 5/488 |
| 2,463,728 | 3/1949 | Wallin . | |
| 3,343,183 | 9/1967 | Sannes | 5/488 |
| 3,466,679 | 9/1969 | Hess | 5/488 |
| 3,641,600 | 2/1972 | Oats | 5/488 |
| 3,810,263 | 5/1974 | Taylor et al. . | |
| 4,034,972 | 7/1977 | Peterson | 269/324 |
| 4,333,637 | 6/1982 | Shelton | 5/488 |
| 4,358,865 | 11/1982 | Pagel et al. | 5/488 |
| 4,926,513 | 5/1990 | Oats | 5/488 |
| 4,948,062 | 8/1990 | Mahar et al. | 242/67.3 R |
| 5,718,009 | 2/1998 | Lin | 5/488 |

FOREIGN PATENT DOCUMENTS

| | | | |
|---|---|---|---|
| 0005555 | 11/1979 | European Pat. Off. | 5/487 |

*Primary Examiner*—Michael F. Trettel

[57] ABSTRACT

A paper handling device is provided to receive soiled paper following exposure of the paper to cover and protect a patient contact surface of a table used for medical examinations or treatments. Lateral coverage of the patient contact surface provides for usage to protect the area of the medical table corresponding to the head area of the patient, as typically used for chiropractic tables. Longitudinal coverage of the patient contact surface provides for usage to protect the entire medical table. The device provides for the repetitive usage of the medical table without requiring attending medical personnel to physically come into contact with the soiled paper following each usage. The method of measuring the paper being transferred ensure that with each respective cycle sufficient fresh paper is released from the dispensing device to provide for coverage of the patient contact surface. The prevention of contamination of the sterile source of the paper by previously exposed paper is explained in the form of unidirectional rotation of the dispensing roll. Similarly, the prevention of release of previously gathered soiled paper is explained. Housing units covering the dispensing roll as well as the take-up roll respectively protect the fresh supply and the gathered soiled paper.

12 Claims, 4 Drawing Sheets

12
10
14
16
18
20
22
24
26
28
30
32
40
42
44
48
50
52
54
56
2

PAPER HANDLING DEVICE

BACKGROUND

1. Field of the Invention

Generally, the invention relates to devices which gather an increment of continuous paper, where the paper is used as a sanitary coverage on medical tables, following the increments exposure to contact with a patient. More specifically, the invention relates to such devices used on chiropractic tables.

2. Description of the Prior Art

Medical tables upon which patients rest utilize sanitary paper to cover the surfaces which a patient rests upon. These surfaces are hereafter referred to as patient contact surfaces. Therefore, the patient contacts the sanitary paper during an examination or a treatment procedure. Following the contact with the patient, removal and disposal of the exposed sanitary paper occurs. Placement of a fresh supply of sanitary paper occurs prior to use of the medical table with another patient.

A common usage is to have the sanitary paper held on a dispensing roll which is secured to the table adjacent the patient contact surface being covered. Positioning of a securing clamp or other securing device on the table may occur on the opposing side of the patient contact surface from the dispensing roll. Following usage, the exposed paper is released by the securing device and paper is pulled through the securing device while the dispensing roll releases a fresh supply of paper. When all of the previously exposed paper has been moved through the securing device, and only fresh paper remains exposed between the securing device and the dispensing roll, the securing device is reactivated. The soiled paper is then removed by tearing or cutting and disposed of in a waste container.

This method results in a requirement that an attending medical personnel come into physical contact with the soiled paper during the tearing or cutting procedure. Additionally, the attending medical personnel then must deal with the severed increment of soiled paper following each medical procedure. This disposal is generally accomplished by folding or wadding the paper up for placement into the waste container. This generally results in the soiled paper consuming a greater volume of space than would result if the soiled paper were rolled up.

For these reasons there remains a need for a simple device which can collect the used paper without requiring excessive contact by the attending medical personnel or requiring individual disposal of each increment of soiled paper. The present invention substantially fulfills these needs.

SUMMARY

In view of the foregoing disadvantages inherent in the conventional method of handling the disposable sanitary paper following the paper's contact with a patient, your applicant has devised a method of collecting this soiled paper without requiring physical contact therewith by the attending medical personnel.

In a first embodiment, a collection device is provided to gather soiled paper, being used disposable sanitary paper from a continuous supply, following exposure of the paper to cover a patient contact surface of a medical table. A take-up roll is attached to the medical table, which may be a chiropractic table. The take-up roll receives a free end of the continuous supply of the disposable sanitary paper, such as on a dispensing roll or a fan fold supply. Means to provide for rotation of the take-up roll causes the take-up roll to wind the soiled paper, covering the patient contact surface, onto the take-up roll. This action causes a fresh increment of disposable sanitary paper from the continuous supply to cover the patient contact surface of the medical table for a subsequent medical procedure performed on another patient.

In a second embodiment, a device, having both a dispensing roll and a take-up roll, is provided to both dispense a fresh increment of a disposable sanitary paper from a roll as well as gather previously exposed paper upon the take-up roll. This device is specifically designed for a chiropractic table. Means to provide for rotation of the take-up roll causes the take-up roll to wind the exposed paper, covering the patient contact surface, onto the take-up roll. This action causes the fresh increment of disposable sanitary paper from the dispensing roll to cover the patient contact surface of the chiropractic table for a subsequent chiropractic treatment.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

The primary object of the present invention is to provide for a gathering of soiled disposable sanitary paper from a continuous supply covering a patient contact surface of a medical table without requiring contact with the soiled paper by attending medical personnel.

Other objects include;

a) to provide for a recovering of the patient contact surface with a fresh increment of disposable sanitary paper from the continuous supply contemporaneously with the removal of the soiled paper without requiring contact with the fresh increment by attending medical personnel.

b) to provide for a device to perform the gathering of the soiled paper.

c) to provide for a device to perform both the gathering of the soiled paper and the supplying of a fresh increment of disposable sanitary paper.

d) to provide for usage with medical tables.

e) to provide for usage with chiropractic tables.

f) to provide for usage to manipulate disposable sanitary paper at a location on the table corresponding to a head area of a patient.

g) to provide for usage to manipulate disposable sanitary paper at a location on the table corresponding to a torso area of a patient.

h) to provide for a take-up roll to gather previously used paper.

i) to provide for a take-up roll housing member to shield the soiled paper on the take-up roll from contact with outside objects.

j) to provide for a manually operated crank to cause rotation of the take-up roll.

k) to provide for a motor to cause rotation of the take-up roll.

l) to provide for a switch to activate rotation of the take-up roll.

m) to provide for a measuring of the paper transferred by the device to ensure that the device operates properly to ensure adequate transfer of fresh paper to cover the patient contact surface.

n) to provide for the take-up roll to be mounted below the patient contact surface on the table to enhance aesthetic appeal of the table.

o) to provide for a restriction of the direction of rotation of the dispensing roll to prevent contamination of the supply of disposable sanitary paper by previously exposed paper.

p) to provide for a restriction of the direction of rotation of the take-up roll to prevent exposure of previously collected soiled paper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
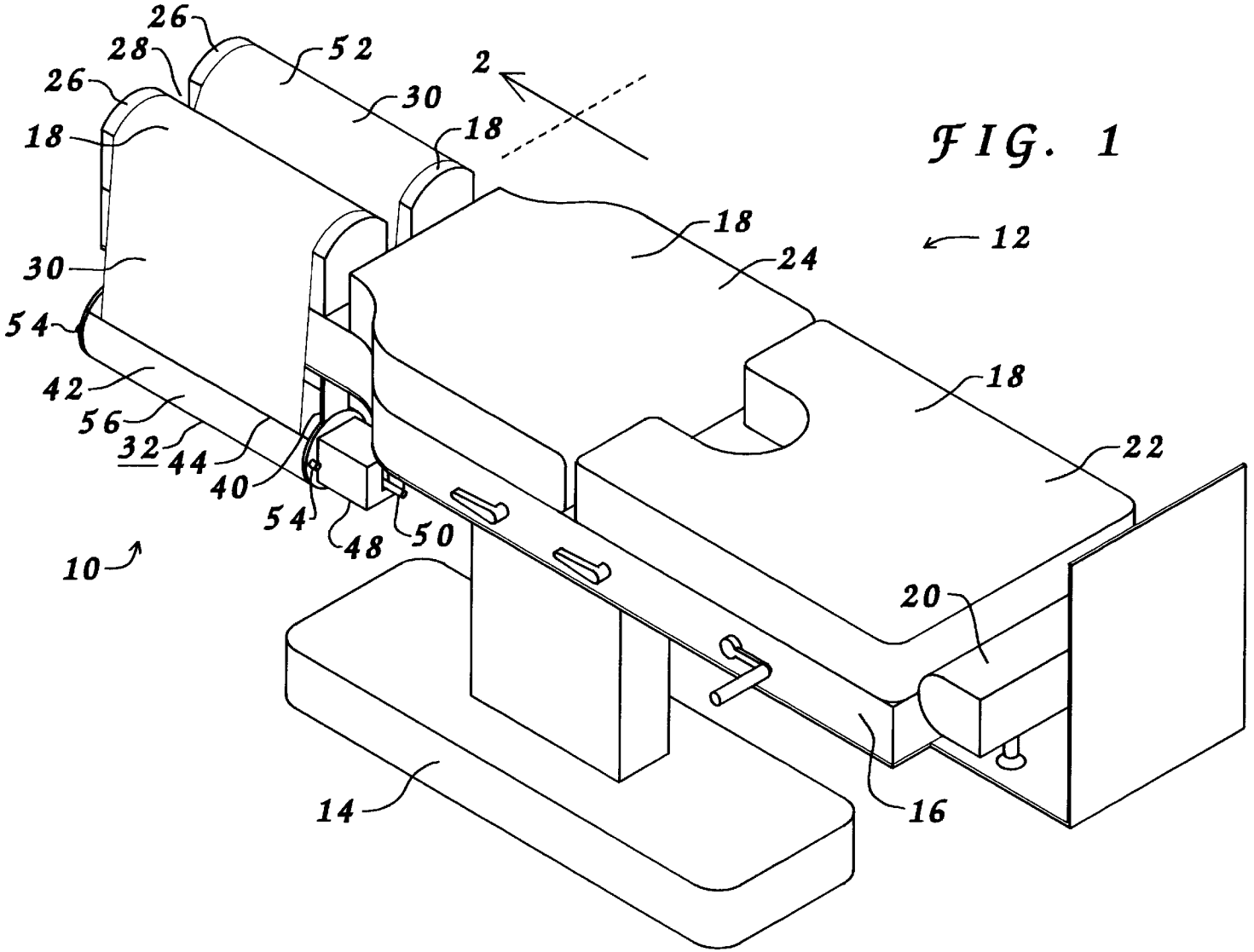
FIG. 1 is a perspective view of a chiropractic table having a paper handling system attached thereto.
Figure 2:
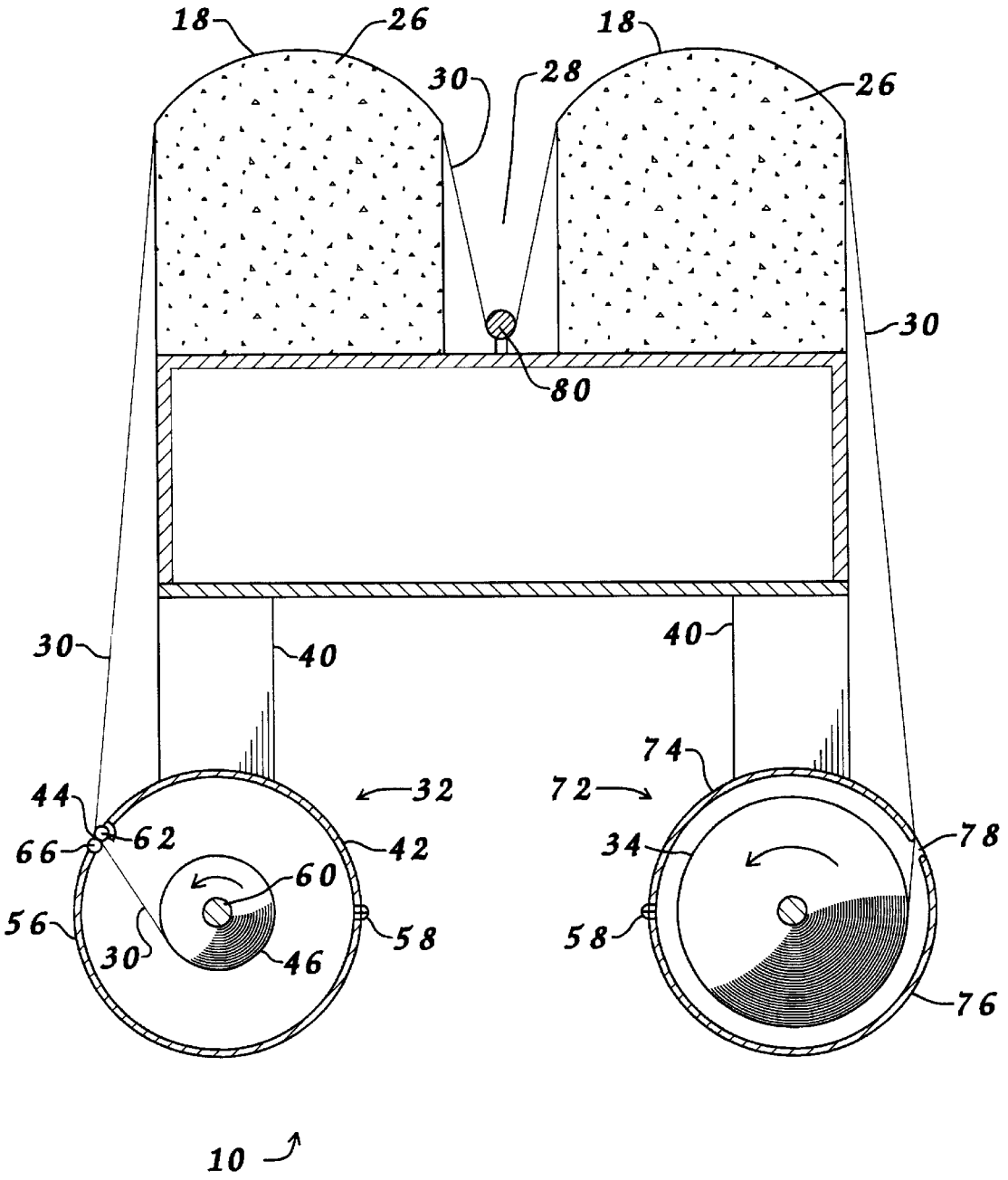
FIG. 2 is a sectional view as taken from the section line '2' shown in FIG. 1.
Figure 3:
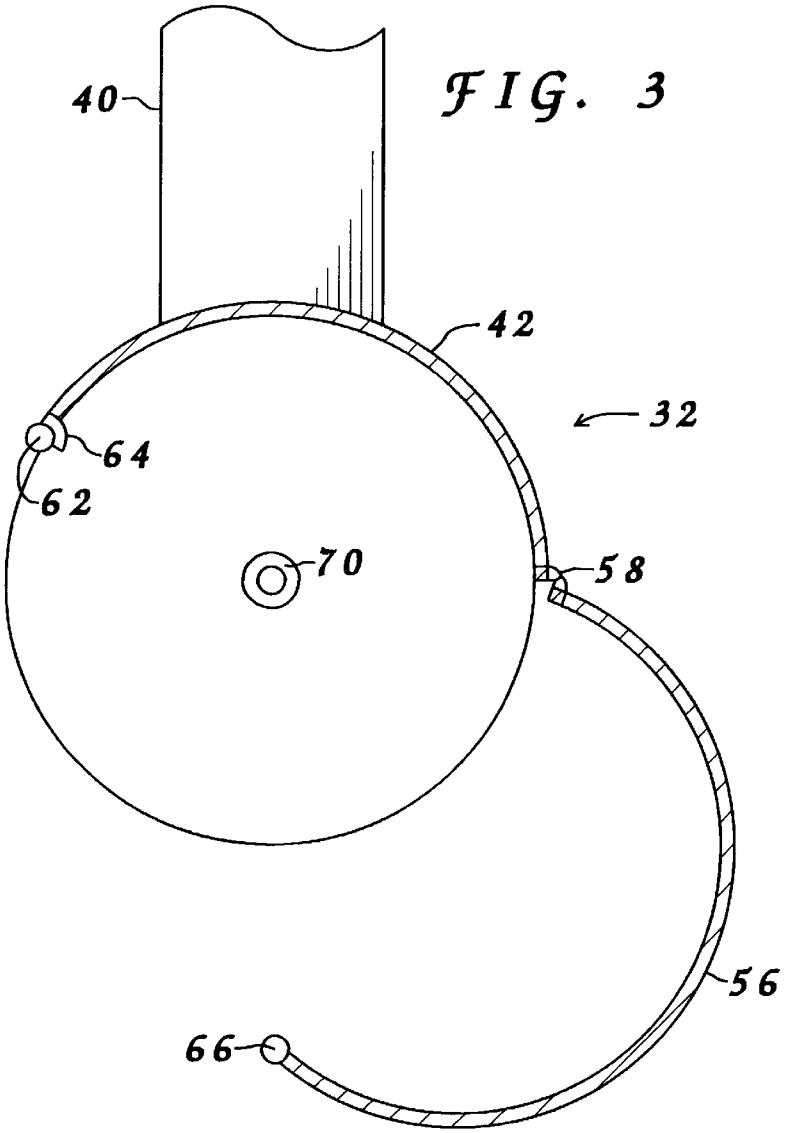
FIG. 3 is an enlarged sectional view of the collection device shown in FIG. 2.

Referring now to the drawings where like reference numerals refer to like parts throughout the various views. Referring to FIG. 1 through FIG. 3, a paper handling system 10 is depicted for the dispensing of disposable sanitary paper and the subsequent collection thereof. In practice, paper handling system 10 may be used in it's entirety, or in the case where a paper dispensing apparatus already exists on a specific table, the collection aspect of the device may be employed singularly to function with the existing paper dispensing apparatus.

A chiropractic table 12 having a base 14 and a support platform 16, as conventionally known in the art, is shown in FIG. 1. Various pads having compressible characteristics are distributed on chiropractic table 12 forming a patient contact surface 18. These pads include an ankle pad 20, a lower body pad 22, a torso pad 24 and opposing head pads 26.

Opposing head pads 26 have a spacing 28 therebetween to allow a patient, not shown in any of the views, to comfortably lie face down on patient contact surface 18 without obstructing the patient's breathing.

A paper 30 is used to cover and protect patient contact surface 18, as conventionally known in the art. The covering of patient contact surface 18 with a disposable coverage provides for reuse of chiropractic table 12 in an extremely short period of time. Additionally, paper 30 ensures that the subsequent patient is contacting a sanitary material as compared to a surface which may have been in contact with another patient. While paper is the common material used for this purpose in the medical field, other materials may be employed as substitutes.

Figure 4:
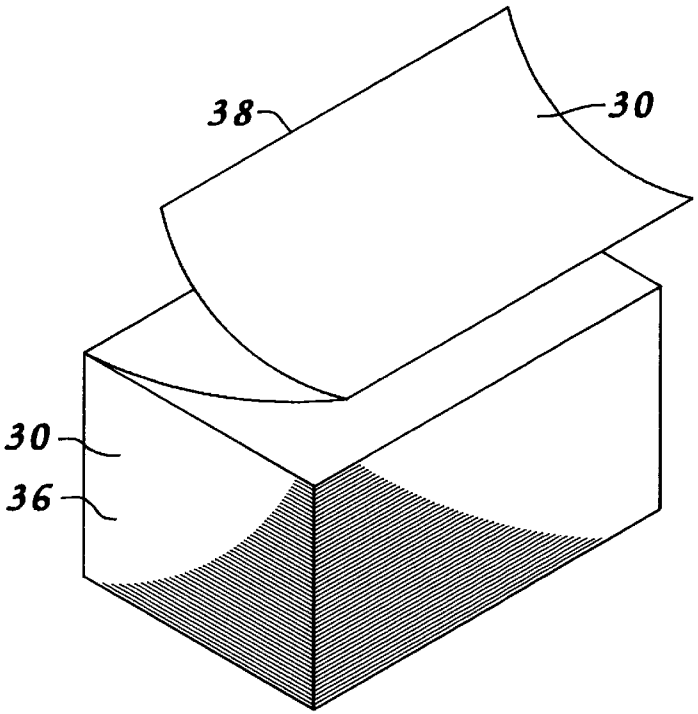
FIG. 4 is a perspective view of a stack of fan fold paper.

A collection device 32 is provided to permit a gathering of paper 30 without necessitating physical contact with soiled paper 30 by attending medical personnel, such personnel not shown in any of the views. Paper 30 may come from any source of continuous paper. Normally, paper 30 will be in roll form as exampled by a dispensing roll 34, as shown in FIG. 2. Other sources of continuous paper include a fan fold stack 36, shown in FIG. 4. Without regard for the source of continuous paper, each source will have a free end 38, shown in FIG. 4, which is accessible for connection to collection device 32.

Any attachment method conventionally known in the art may be used to attach collection device 32 to chiropractic table 12. One example has opposing mounting brackets 40 attaching collection device 32 to chiropractic table 12.

Collection device 32 may have a take-up roll housing member 42. Take-up roll housing member 42 provides for containment of any soiled paper 30 gathered into collection device 32 to prevent contact with outside objects. An access slot 44 provides for entry of paper 30 into collection device 32.

Various methods may be employed to power collection device 32 to cause a gathering of paper 30 onto a take-up roll 46, see FIG. 2. FIG. 1 depicts a motor 48 which causes rotation of take-up roll 46. A switch 50, located in a position on chiropractic table 12 which prevents accidental activation, allows the attending medical personnel to activate motor 48 when it is desired to gather exposed paper 30 and place a fresh increment 52 of paper 30 onto patient contact surface 18.

Access latches 54, located on collection device 32, provide for access to the interior of collection device 32 by opening a door 56. Referring now specifically to FIG. 2 and FIG. 3, door 56 is hingedly attached to take-up roll housing member 42 by a hinge 58. Take-up roll 46 receives free end, not shown in these views, of paper 30 using any of the connection methods known in the art. A roller 60 allows take-up roll 46 to rotate within take-up roll housing member 42 to permit the gathering of paper 30 thereon. Following the opening of door 56, mounting of roller 60 and take-up roll 46 within take-up roll housing member 42 is facilitated by any of the methods known in the art. When take-up roll 46 is fully loaded with soiled paper 30, door 56 is opened and soiled paper 30 is removed and disposed of.

In use, between treatments of sequential patients, the attending medical personnel would cause a gathering of paper 30 exposed during treatment of a first patient. The attending medical personnel may visually determine when previously exposed paper 30 has been completely gathered into collection device 32. Following this gathering, fresh increment 52 of paper 30 will have been placed on patient contact surface 18 to provide coverage and protection thereto. Alternatively, a method may be used to measure paper 30 entering collection device 32, passing a fixed point on chiropractic table 12 or leaving dispensing roll 34. This method ensures that all paper 30 exposed during a proceeding treatment has been removed prior to beginning the subsequent treatment of another patient.

A measuring roller 62 cooperates with a counter device 64 to measure the length of paper 30 entering access slot 44. Paper 30 is sandwiched between a roller 66 and measuring roller 62. When paper 30 is drawn onto take-up roll 46 roller 66 and measuring roller 62 rotate in synch with the passage of paper 30 through access slot 44. Counter device 64 then transfers a signal to motor 48 to terminate the gathering process when the length of paper 30 passing through access slot 44 equals an amount sufficient to ensure that previously exposed paper 30 has been gathered. When alternative rotation generating gathering methods are employed, as exampled by use of a crank 68, shown in FIG. 5, a completion indicator may be employed to inform the attending medical personnel of completion of the transfer process. Examples include locking of the winding mechanism or activation of an audible indicator.

Once soiled paper 30 has been gathered into collection device 32 it is desired that such paper 30 not be allowed to be pulled back out of collection device 32. This prevents possible contamination of outside objects by such soiled paper 30. When motor 48 is used, a drive mechanism, as conventionally known and not shown, may prevent reverse rotation of take-up roll 46. When other rotation generation methods are employed, a clutch bearing 70, shown in FIG. 3, and as conventionally known in the art, may be used to restrict rotation of take-up roll 46 to a single direction. A similar configuration may be used to prevent paper 30 which has left dispensing roll 34 from being replaced on dispensing roll 34.

A dispensing device 72 may have dispensing roll housing member 74 to protect paper 30 on dispensing roll 34 from contamination. Dispensing roll housing member 74 has a door 76 to provide access to install a fresh dispensing roll 34 therein. The method of mounting dispensing roll 34 may be selected from any of the many ways conventionally known in the art. An access slot 78 provides for passage of paper 30 out of dispensing roll housing member 74.

In usage, fresh increment 52 of paper 30 must at least partially cover the respective patient contact surface which is to be protected. Fresh paper 30 is fed from dispensing roll 34 or the existing conventionally known paper dispensing unit. Paper 30 then traverses patient contact surface 18, comprising opposing head pads 26, shown in FIG. 1 and FIG. 2. Paper 30 then is wound on take-up roll 46, which may comprise take-up roll housing member 42. Opposing head pads 26 provide for spacing 28 therebetween, as previously disclosed. In order to continue to provide spacing 28 between opposing head pads 26, a roller 80 retains the path of paper 30 toward the lower extent of spacing 28. Paper 30 or roller 80 may be manipulated to allow for installation of paper 30 below roller 80.

Collection device 32 ideally is positioned on a specific medical table in a position which places it out of the way during any conceivable medical procedure performed on the respective medical table. Such positioning is exampled by being below the elevational height of patient contact surface 18 and inward from the peripheral edge of the table, as depicted in the various views. Alternatively, to reduce wasting paper 30, dispensing device 72 and collection device 32 may be attached to the table adjacent the respective patient contact surface being protected near the peripheral edge of the table.

The above identified embodiment depicts paper 30 extending across the short length of the table, as is ideal for chiropractic tables. Similarly, paper handling system 10 could be employed transversely on chiropractic table 12 to provide protection to the area of patient contact surface 18 corresponding to either torso pad 24 or lower body pad 22 or both. The instant invention is equally suitable for longitudinal coverage of a medical table, including chiropractic table 12 and general purpose examination tables.

Figure 5:
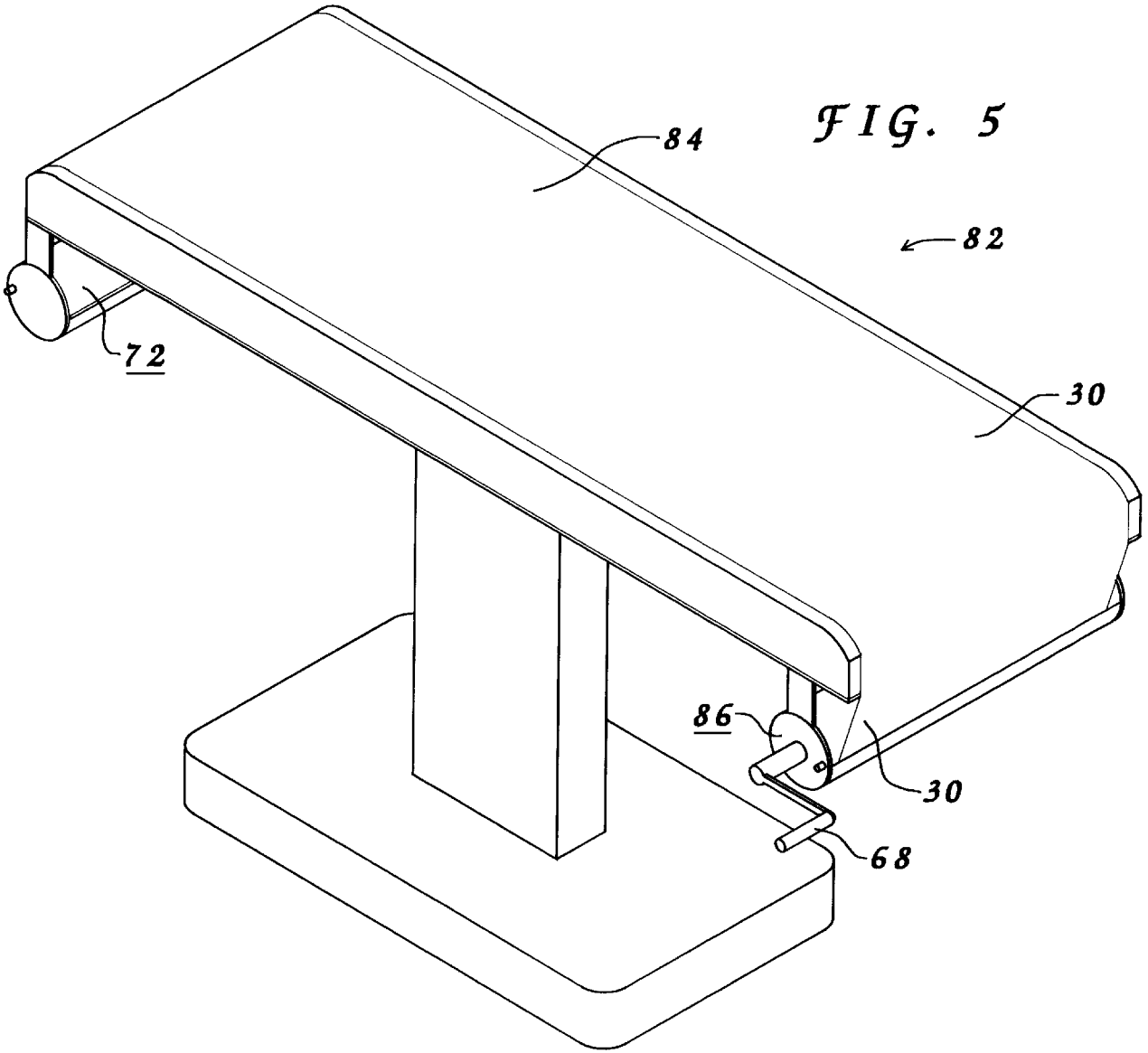
FIG. 5 is a perspective view of a medical table having a dispensing device and a collection device attached thereto.

FIG. 5 depicts a medical table 82 having a patient contact surface 84, generally covered by paper 30. Paper 30 originates in dispensing device 72, having features previously disclosed, and mounted at a first longitudinally spaced end of medical table 82. Paper 30 then extends along the longitudinal length of medical table 82 covering patient contact surface 84 and enters a collection device 86. Collection device 86 is mounted at a second longitudinally spaced end of medical table 82. Collection device 86 generally has the features disclosed above for collection device 32 with the exception of the rotation generation means used. Collection device 86 relies upon crank 68 to produce the required rotation within collection device 86.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collection device to gather a soiled paper, the collection device attachable to a chiropractic table, the chiropractic table having a continuous supply of a disposable sanitary paper, the disposable sanitary paper of the continuous supply having a free end, the disposable sanitary paper to cover and protect a patient contact surface of the chiropractic table during a chiropractic treatment of a patient and wherein the patient contact surface is in a location on the chiropractic table corresponding to a head area of the patient while the patient rests upon the chiropractic table for the chiropractic treatment, the collection device comprising:

a) a take-up roll to receive the soiled paper, the soiled paper being the disposable sanitary paper previously exposed to cover the patient contact surface of the chiropractic table during the chiropractic treatment;

b) free end securing means to provide for securing the free end of the disposable sanitary paper to the take-up roll;

c) take-up roll rotation generation means to provide for selectively causing the take-up roll to rotate whereby a winding of the soiled paper onto the take-up roll occurs, the winding of the soiled paper causing a fresh increment of disposable sanitary paper from the continuous supply to covers the patient contact surface of the chiropractic table for a subsequent chiropractic treatment of another patient;

d) attachment means to provide for attaching the collection device to the chiropractic table in close proximity to the patient contact surface;

and wherein the collection device is attached to the chiropractic table wherein the paper traverses the location on the chiropractic table corresponding to the head area of the patient;

whereby the take-up roll rotation generation means causes the take-up roll to rotate to cause the winding of the soiled paper onto the take-up roll causing the fresh increment of disposable sanitary paper from the continuous supply to cover the patient contact surface of the chiropractic table.

2. The collection device defined in claim 1 further comprising containment means to provide for a shielding of the soiled disposable sanitary paper on the take-up roll from contact with outside objects.

3. The collection device defined in claim 2 wherein the containment means further comprises a take-up roll housing member, the take-up roll housing member having an access slot, the access slot allowing entry of the soiled paper into the take-up roll housing member and wherein the take-up roll housing member is attached to the chiropractic table below the patient contact surface and adjacent a periphery edge of the patient contact surface.

4. The collection device defined in claim 1 further comprising measuring means to provide for a control of the take-up roll rotation generation means to provide for a transfer of a select quantity of the soiled paper onto the take-up roll, the select quantity sufficient to ensure that the soiled paper exposed on the patient contact surface following the chiropractic treatment is placed upon the take-up roll.

5. The collection device defined in claim 1 further comprising a switch and a motor, the switch to activate the motor, the motor to activate the take-up roll rotation generation means.

6. A device for a chiropractic table to provide for dispensing from a continuous supply a disposable sanitary paper and for subsequent collection of the disposable sanitary paper previously exposed during a chiropractic treatment of a patient, the disposable sanitary paper to cover and protect a patient contact surface of the chiropractic table during the chiropractic treatment of the patient and wherein the patient contact surface is in a location on the chiropractic table corresponding to a head area of the patient while the patient rests upon the chiropractic table for the chiropractic treatment, the device comprising:

a) a dispensing device to provide for a rotatable securing of a dispensing roll of the continuous supply of the disposable sanitary paper, the dispensing roll having a free end;

b) a take-up roll to receive an exposed paper, the exposed paper previously exposed disposable sanitary paper from the continuous supply and exposed during the chiropractic treatment;

c) free end securing means to provide for securing the free end of the dispensing roll to the take-up roll;

d) take-up roll rotation generation means to provide for selectively causing the take-up roll to rotate whereby a winding of the exposed paper onto the take-up roll occurs, the winding of the exposed paper causing the dispensing roll to rotate whereby a fresh increment of the continuous supply of the disposable sanitary paper is released from the dispensing roll and covers the patient contact surface of the chiropractic table for a subsequent chiropractic treatment of another patient;

e) attachment means to provide for attaching the device to the chiropractic table in close proximity to the patient contact surface;

and wherein the collection device is attached to the chiropractic table wherein the paper traverses the location on the chiropractic table corresponding to the head area of the patient:

whereby the take-up roll rotation generation means causes the take-up roll to rotate to cause the winding of the exposed paper onto the take-up roll causing the fresh increment of the disposable sanitary paper to be released from the dispensing roll to place the fresh increment of the disposable sanitary paper to cover the patient contact surface of the chiropractic table.

7. The device defined in claim 6 further comprising containment means to provide for a shielding of the exposed paper on the take-up roll from contact with outside objects.

8. The device defined in claim 6 wherein the containment means further comprises a take-up roll housing member, the take-up roll housing member having an access slot, the access slot allowing entry of the exposed paper into the take-up roll housing member.

9. The device defined in claim 8 wherein the take-up roll housing member is attached to the chiropractic table below the patient contact surface and adjacent a periphery edge of the patient contact surface.

10. The device defined in claim 6 wherein the dispensing roll further comprises directional restricted means to provide for an unidirectional rotation of the dispensing roll within the dispensing device, the unidirectional rotation allowing for a release of the disposable sanitary paper from the dispensing roll.

11. The device defined in claim 6 further comprising measuring means to provide for a control of the take-up roll rotation generation means to provide for a transfer of a select quantity of the exposed paper onto the take-up roll, the select quantity sufficient to ensure that the exposed paper exposed on the patient contact surface following the chiropractic treatment is placed upon the take-up roll.

12. A collection device to gather a soiled paper, the collection device attachable to a chiropractic table, the chiropractic table having a continuous supply of a disposable sanitary paper, the disposable sanitary paper of the continuous supply having a free end, the disposable sanitary paper to cover and protect a patient contact surface of the chiropractic table during a chiropractic treatment of a patient and wherein the patient contact surface is in a location on the chiropractic table corresponding to a head area of the patient while the patient rests upon the chiropractic table for the chiropractic treatment, the collection device comprising:

a) a take-up roll to receive the soiled paper, the soiled paper being the disposable sanitary paper previously exposed to cover the patient contact surface of the chiropractic table during the chiropractic treatment;

b) containment means to provide for a shielding of the soiled disposable sanitary paper on the take-up roll from contact with outside objects;

c) free end securing means to provide for securing the free end of the disposable sanitary paper to the take-up roll;

d) take-up roll rotation generation means to provide for selectively causing the take-up roll to rotate whereby a winding of the soiled paper onto the take-up roll occurs, the winding of the soiled paper causing a fresh increment of disposable sanitary paper from the continuous supply to covers the patient contact surface of the chiropractic table for a subsequent chiropractic treatment of another patient;

e) attachment means to provide for attaching the collection device to the chiropractic table in close proximity to the patient contact surface;

and wherein the collection device is attached to the chiropractic table wherein the paper traverses the location on the chiropractic table corresponding to the head area of the patient;

whereby the take-up roll rotation generation means causes the take-up roll to rotate to cause the winding of the soiled paper onto the take-up roll causing the fresh increment of disposable sanitary paper from the continuous supply to cover the patient contact surface of the chiropractic table.

* * * * *